US009469314B2

(12) United States Patent
Haas

(10) Patent No.: US 9,469,314 B2
(45) Date of Patent: Oct. 18, 2016

(54) IMPACT PROTECTION FOR A RUNNING GEAR OF A RAIL VEHICLE

(71) Applicant: Bombardier Transportation GmbH, Berlin (DE)

(72) Inventor: Jan-Philipp Haas, Kassel (DE)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 14/614,662

(22) Filed: Feb. 5, 2015

(65) Prior Publication Data

US 2015/0232107 A1 Aug. 20, 2015

(30) Foreign Application Priority Data

Feb. 19, 2014 (EP) ..... 14155801

(51) Int. Cl.
*B61F 19/00* (2006.01)
*B61C 17/00* (2006.01)

(52) U.S. Cl.
CPC ..... *B61F 19/00* (2013.01); *B61C 17/00* (2013.01)

(58) Field of Classification Search
CPC ..... B61F 19/00; B61F 19/02; B61F 19/04; B61F 19/06; B61F 19/08; B61F 19/10; B61C 17/00
See application file for complete search history.

(56) References Cited

U.S. PATENT DOCUMENTS 74,980 A * 3/1868 Brady ..... B61F 19/02 293/58
1,325,705 A * 12/1919 Sleeman ..... B61F 19/02 293/58
1,345,916 A * 7/1920 Feiden, Jr. ..... B61F 19/02 293/58
1,397,825 A * 11/1921 Thompson ..... B61F 19/02 293/58
1,451,243 A * 4/1923 Viberg ..... B61F 5/06 105/192
1,691,018 A * 11/1928 Scott ..... B61F 19/02 291/38
2,567,443 A * 9/1951 O'Meara ..... B60R 19/023 180/271
4,723,807 A * 2/1988 Pruett ..... B60B 17/00 295/1
7,605,690 B2 10/2009 Schroeder-Bodenstein
8,479,658 B2 * 7/2013 Langerwisch ..... B61D 17/02 105/1.1
2007/0296561 A1 * 12/2007 Schroeder-Bodenstein ..... B61K 9/00 340/426.16
2010/0127133 A1 * 5/2010 Schrevere ..... B61F 19/00 246/169 S
2012/0272858 A1 * 11/2012 Schmidt ..... B61D 17/02 105/413
2014/0310908 A1 * 10/2014 Shimokawa ..... B61F 5/38 15/256.5
2015/0059612 A1 * 3/2015 Calomfirescu ..... B61F 19/00 105/392.5

FOREIGN PATENT DOCUMENTS

DE 102006004814 A1 6/2007
DE EP 2368781 A1 * 9/2011 ..... B61F 19/06
EP 0050200 A1 4/1982

(Continued)

*Primary Examiner* — Jason C Smith
(74) *Attorney, Agent, or Firm* — The Webb Law Firm

(57) ABSTRACT

A running gear for a rail vehicle includes a wheel set, a running gear frame and a shielding device, the running gear frame being supported on the wheel set. The shielding device is connected to the running gear frame via a support structure and is spatially associated to at least a shielded component of the running gear. The shielding device shields a shielded part of the shielded component against impacts of objects lifted from a track used during operation of the vehicle. The shielding device has a carrier element and at least one impact element, the at least one impact element being mounted to the carrier element for covering the carrier element and forming an impact surface for said objects. The impact element has at least one load bearing structural element made from a fiber reinforced composite material.

17 Claims, 3 Drawing Sheets

(56) References Cited

FOREIGN PATENT DOCUMENTS

| | | | | |
|---|---|---|---|---|
| EP | 1852326 A2 | 11/2007 | | |
| EP | 2517944 A2 | 10/2012 | | |
| GB | WO 03016119 A1 * | 2/2003 | ..... | B61F 19/02 |
| WO | 03016119 A1 | 2/2003 | | |
| WO | 2006021514 A1 | 3/2006 | | |
| WO | 2006040754 A2 | 4/2006 | | |

* cited by examiner

IMPACT PROTECTION FOR A RUNNING GEAR OF A RAIL VEHICLE

CROSS-REFERENCE TO RELATED APPLICATION

This application claims priority to European Patent Application No. 14155801.5 filed Feb. 19, 2014, the disclosure of which is hereby incorporated in its entirety by reference.

BACKGROUND OF THE INVENTION

1. Field of the Invention

The invention relates to a running gear for a rail vehicle, in particular a high speed rail vehicle, comprising a wheel set, a running gear frame and a shielding device, the running gear frame being supported on the wheel set. The shielding device is connected to the running gear frame via a support structure and is spatially associated to at least a shielded component of the running gear. The shielding device shields a shielded part of said shielded component of the running gear against impacts of objects, in particular pieces of ballast, lifted from a track used during operation of the vehicle. The shielding device comprises a carrier element and at least one impact element, the at least one impact element being mounted to the carrier element for covering the carrier element and forming an impact surface for said objects.

2. Description of Related Art

Rail vehicles running at high speeds, e.g. at operating speeds beyond 180 km/h or more, often face the problem that, e.g. due to the air flow conditions developing on the underside of the vehicle, typically, in combination with certain adverse events or circumstances, loose objects such as, for example, loose pieces of ballast are lifted from the part of the track currently used (i.e. travelled along) and hit components of the vehicle, in particular, components of the running gear.

Such objects, depending on their relative speed with respect to the vehicle, may not only damage the vehicle components they hit. They may also be further accelerated and reflected back down onto the track bed where their considerably increased kinetic energy eventually causes one or more other objects, typically pieces of ballast, to be lifted up and hit the vehicle. In summary, this may lead to an avalanche effect also referred to as ballast flight with a greatly increased number of pieces of ballast hitting the vehicle underside components in the rear part of a train. Such ballast flight situations may not only lead to a considerable damage to the vehicle. The track and its surroundings may also be heavily affected.

In order to avoid such ballast flight situations it has been suggested in U.S. Pat. No. 7,605,690 B2 (the entire disclosure of which is incorporated herein by reference) to acoustically detect the build up of ballast flight at an early stage, provide a corresponding signal (e.g. to the driver or a vehicle control) and to take appropriate countermeasures such as reducing the speed of the vehicle. However, in particular, on explicit high speed lines, reduction of the operating speed of the vehicle typically is highly undesired. Furthermore, these countermeasures may only become effective after a certain number of impacts and the associated damage to the components hit had already occurred.

As an approach to deal with the vehicle related part of the ballast flight problem it is known to provide protective coatings to the affected vehicle components (e.g. according to EN 13261). However, these coatings, e.g. made of synthetic materials such as polyurethane (PU), are not suited to withstand the high impact loads occurring at very high operating speeds for an appropriate amount of time and, furthermore, require extensive maintenance work (in particular, if directly coated onto the surface of the respective vehicle component). Furthermore, they are not suitable to solve the ballast flight related problems on the track side.

A further approach to deal at least with parts of the ballast flight problem has been suggested in WO 2006/021514 A1 (the entire disclosure of which is incorporated herein by reference). This document discloses a generic running gear for a rail vehicle wherein so called deflector elements are provided. These deflector elements are intended to form a shield protecting components of the vehicle from being hit by such objects lifted up from the track. The generally plate shaped deflector elements, at least in the sections prone to be hit, are explicitly designed to have a very low inclination with respect to the longitudinal direction of the running gear (i.e. the driving direction of the vehicle) to largely avoid any transfer of kinetic energy from the vehicle to the hitting object, which otherwise would be likely to cause the avalanche effect as outlined above.

However, this low inclination of the relevant impact parts of the deflector elements with respect to the longitudinal direction of the running gear results in a very large size of these deflector elements. More precisely, for example, in total, virtually the entire underside of the running gear ahead of a wheel set shaft (including the gap between the wagon body and the bogie in the area of the bogie cutout) has to be shielded in order to protect the wheel set shaft. Such large shielding devices, however, considerably add to the complexity of the running gear. Furthermore, integration of such large shields in a modern high speed running gear (typically having very little free building space available) requires considerable constructional effort.

A similar deflector element approach is known from EP 0 050 200 A1 disclosing generally U-shaped covers for underfloor vehicle components. These self-carrying covers are made of fiber reinforced composite material walls extending substantially parallel to the longitudinal direction, such that they are only exposed to comparatively low impact loads.

Contrary to that DE 10 2006 004 814 A1 discloses a shielding device with a substantially vertical arrangement absorbing ballast impact loads via a ballast impact surface formed by a wire mesh element prone to local damage of individual wires hit by a piece of ballast.

Furthermore, EP 2 517 944 A2 discloses a generic running gear where the shielding device comprises impact energy absorbing elements comprising a wood material as an impact energy absorbing material covering the carrier element. The wood material, while providing good and long term energy absorption, has the disadvantage that it has a comparatively high tendency to absorb water or other liquids going along with a corresponding swelling of the impact element compared to its dried state. This leads to problems or increased efforts, respectively, in mounting the impact element in a long term stable manner despite its strongly and periodically altering geometry over time. A further problem with such a wood material is the general low resistance to fire, such that appropriate additional measures have to be taken to improve fire resistance of the wood material in order to respect operator standards or official regulations regarding fire safety.

SUMMARY OF THE INVENTION

It is thus an object of the invention to, at least to some extent, overcome the above disadvantages and to provide a running gear that, with simple design and reduced expense, provides long-term proper impact protection of the components of the running gear while at the same time keeping the risk of ballast flight low.

This and other objects are achieved according to the present invention which is based on the technical teaching that a running gear having simple, cheap and compact design while providing long-term proper impact protection of the vehicle components at low risk of ballast flight may be achieved if the impact element comprises at least one load bearing structural element made from a fiber reinforced composite material. Such a composite material has the advantage that it may be easily configured to have low weight and way lower liquid absorption, in particular, water absorption, compared to the wood material of the carrier cover known from EP 2 517 944 A2, while at the same time maintaining high impact energy absorption properties and long term overall structural integrity. Similar applies to the maximum swelling (i.e. the size and/or shape difference between the state with maximum water absorption and the fully dried state). Furthermore, such composite materials can be tailored to inherently be more fire resistant than the wood material known.

It will be appreciated, in particular, that reinforcement fiber configurations may be achieved which provide a similar effect as the natural fibers of the wood material known. Furthermore, the invention allows implementation of configurations which are beneficial under the aspect of maintaining long-term overall structural integrity of the impact element despite randomly distributed high impact loads under random impact situations as they occur with objects randomly lifted from the track currently traveled.

More precisely, impact elements having randomized alignment of the reinforcement fibers used in the structural element provide the beneficial effect that, compared to configurations with a defined mutual alignment of the reinforcement fibers (e.g. parallel fibers), an edge portion of an object hitting the impact surface only hits a reduced number of fibers under an angle which is suitable for cutting (or otherwise destroying) the fibers. Hence, overall, even under such adverse random impact load situations reduce damage and, hence, long-term overall structural integrity of the impact element may be achieved in a very simple manner.

Thus, according to one aspect, the present invention relates to running gear for a rail vehicle, in particular a high speed rail vehicle, comprising a wheel set, a running gear frame and a shielding device. The running gear frame is supported on the wheel set, the shielding device being connected to the running gear frame via a support structure and being spatially associated to at least a shielded component of the running gear. The shielding device shields a shielded part of the shielded component against impacts of objects, in particular pieces of ballast, lifted from a track used during operation of the vehicle. The shielding device comprises a carrier element and at least one impact element, the at least one impact element being mounted to the carrier element for covering the carrier element and forming an impact surface for said objects. The impact element comprises at least one load bearing structural element made from a fiber reinforced composite material.

It will be appreciated that the structural element, basically, may have any desired and suitable configuration. For example, one or more fiber layers with defined mutual orientation of the fibers used may be provided. For example, one or more fiber layers with mutually parallel fibers (i.e. so-called unidirectional fiber layers) may be used. Furthermore, it will be appreciated that a plurality of such unidirectional fiber layers with mutual inclination of the fibers of different layers may be used.

Preferably, the structural element comprises at least one woven fiber layer, in particular, a fiber texture. With such an arrangement particularly strong and enduring configurations may be achieved.

In addition or as alternative, preferably, the structural element comprises at least one nonwoven fiber layer, in particular, a fiber mat or fiber felt, the nonwoven fiber layer. With such a nonwoven fiber layer it is in particular possible to achieve the randomized orientation of the reinforcement fibers used as outlined above. Hence, ultimately, the isotropic properties of such a nonwoven fiber layer, as they may be achieved, for example, with such a randomized fiber arrangement are highly beneficial. Hence, particularly long-term enduring configurations may be achieved using such nonwoven fiber layers. In particular with respect to the long-term overall structural integrity, such a nonwoven fiber layer is particularly efficient if, in a configuration with a plurality of fiber layers, it forms the one of this plurality of fiber layers which is located closest to the impact surface.

Eventually one single such fiber layer may be sufficient. Preferably, the structural element comprises a plurality of such fiber layers. Particularly advantageous configurations may be achieved using a combination of at least one woven fiber layer and at least one nonwoven fiber layer.

It will be appreciated that, generally, any desired and suitable global alignment of the reinforcement fibers of the fiber layers as outlined above may be chosen. The global alignment of the reinforcement fibers may, in particular, be chosen as a function of the specific functionality of the respective fiber layer to be obtained within the impact element. Preferably, at least 50% to 80% of the reinforcement fibers at least predominantly, preferably substantially fully, extend parallel to the plane of main extension of their respective fiber layer.

With further preferred embodiments of the invention, the structural element is a laminate element, in particular a high-pressure laminate element, comprising a plurality of layers. In this case particular simple to manufacture configurations having high strength and durability may be achieved.

It will be appreciated that, basically, any desired type of reinforcement fiber may be used. Preferably, the structural element comprises at least one fiber layer comprising fibers, in particular synthetic fibers, the fibers, in particular being, glass fibers and/or carbon fibers and/or aramid fibers.

It will be appreciated that different fiber layers may comprise different types of reinforcement fibers, e.g. fibers made from different materials, fibers of different dimensions (e.g., fiber diameter and/or fiber length). In particular, the properties (e.g. material and/or dimensions) for the fibers of the respective fiber layer may be selected as a function of the location and/or functionality of the respective fiber layer. For example, the fiber layer located closest to the impact surface may be provided with fibers having a lower elastic modulus and/or a higher tensile strength compared to the fibers of the one or more other fiber layer(s) located further remote from the impact surface.

Similarly, basically, any desired way of bonding the reinforcement fibers may be implemented within the structural element. For example, the material of the fibers themselves may be provided mutual bonding among the fibers. Preferably, the structural element comprises a matrix material embedding the fibers. Basically, any desired and suitable matrix material may be used. Preferably, the matrix material is a resin. Again, generally, any desired resin may be used. Particularly simple and easy to manufacture configurations use an epoxy resin has the matrix material.

With certain preferred embodiments of the invention, the structural element comprises a filler material, in particular, a mineral filler material. By this means very robust and light configurations may be achieved.

With certain preferred embodiments of the invention having particularly good and long-term stable impact protection behavior, the structural element has a water absorption value of less than 25%, preferably less than 20%, more preferably 10% to 15%. Such a low water absorption, in particular, is highly beneficial in terms of the low swelling of the structural element and, hence, the low alteration in the shape and/or size of the structural element, which in turn influences the effort for providing long-term stable mounting of the structural element and, hence, the impact element.

Preferably, the structural element has an impact strength above 15 $kJ/m^2$, preferably 20 $kJ/m^2$ to 40 $kJ/m^2$, more preferably 25 $kJ/m^2$ to 30 $kJ/m^2$. By this means, in a very simple manner a long-term enduring, highly stable configuration may be achieved despite the impact loads to be typically expected from objects lifted from a track in such a rail vehicle environment.

Furthermore, preferably, the structural element has a tensile strength above 80 $N/mm^2$, preferably 90 $N/mm^2$ to 120 $N/mm^2$, more preferably 100 $N/mm^2$ to 110 $N/mm^2$. In addition or as an alternative, the structural element preferably has a flexural strength above 150 $N/mm^2$, preferably 160 $N/mm^2$ to 220 $N/mm^2$, more preferably 180 $N/mm^2$ to 200 $N/mm^2$. In addition or as an alternative, the structural element preferably has a tensile elastic modulus of 20,000 $N/mm^2$ to 35,000 $N/mm^2$, preferably 24,000 $N/mm^2$ to 30,000 $N/mm^2$, more preferably 25,000 $N/mm^2$ to 28,000 $N/mm^2$. Furthermore, in addition or as an alternative, the structural element preferably has a flexural elastic modulus of 10,000 $N/mm^2$ to 22,000 $N/mm^2$, preferably 14,000 $N/mm^2$ to 20,000 $N/mm^2$, more preferably 16,000 $N/mm^2$ to 18,000 $N/mm^2$. All these parameters (either alone or in arbitrary combination) provide particularly beneficial properties of the structural element and, ultimately, the impact element since they allow realizing long-term overall structural integrity of the impact element under the impact conditions to be expected while at the same time eventually allowing good impact energy absorption by the impact element.

Furthermore, preferably, the structural element has a density of 1.5 $g/cm^3$ to 2.5 $g/cm^3$, preferably 1.7 $g/cm^3$ to 2.2 $g/cm^3$, more preferably 1.8 $g/cm^3$ to 2.0 $g/cm^3$. By this means, a comparatively lightweight impact element may be achieved while providing long-term endurance and good impact energy absorption.

Furthermore, preferably, said structural element has at least a requirement R7 and hazard level HL2 compliance, preferably a requirement R7 and hazard level HL3 compliance, according to European Norm EN 45545-2. By this means, in particular, a beneficially high fire safety of the impact element may be achieved.

With certain preferred embodiments of the invention, the shielding device and/or the support structure comprises at least one impact energy absorbing device, the impact energy absorbing device being adapted to absorb a noticeable fraction of an impact energy of one of the objects hitting the shielding device. It will be appreciated that the impact energy absorbing device may be located at any desired location in the kinematic chain between the impact surface (hit by the lifted objects) of the shielding device and the running gear frame, which is suitable for providing such impact energy absorption. Preferably, the impact element itself forms the at least one impact energy absorbing device. Hence, with certain embodiments of the invention, the impact element preferably comprises an impact energy absorbing material, in particular, at least one impact energy absorbing layer.

This impact energy absorption by the shielding device itself and/or its support has the advantage that, on the one hand, a steeper inclination with respect to the longitudinal direction if the running gear (or vehicle, respectively) may be selected for the impact surface of the shielding device, while (thanks to the energy absorption) energy transfer to the parts hitting the shielding device is still acceptably low (reducing the risk of ballast flight). This allows a more space saving configuration properly shielding the relevant components of the running gear while being easier to integrate into a modern running gear.

It will be appreciated that the shielding device may be used to shield any desired component of the running gear from such impacts. Preferably, the shielded component is a part of the wheel set, in particular, a wheel set shaft of the wheel set, since, here, the shielding device is particularly beneficial (considering the considerable safety relevance of the structural integrity of the wheel set, in particular, of the wheel set shaft).

The amount of impact energy absorption provided by the energy absorbing device may be selected as a function of the likelihood of ballast flight buildup identified for the specific vehicle (prior to implementation of the present invention). This likelihood, in turn, among others, is a function of the speed range of the vehicle to be expected under normal operating conditions. Here, a relevant magnitude is the nominal maximum operation speed of the vehicle (i.e. the maximum speed to be achieved over longer periods under normal operating conditions), since the risk of ballast flight buildup has to be kept at an acceptable level for this nominal maximum operation speed as well. Thus, in general, it applies that a higher nominal maximum operation speed requires a higher level of impact energy absorption.

With preferred embodiments of the invention, the shielding device shields the shielded part against impacts of pieces of ballast lifted from a ballast bed of a track used during operation of the vehicle, wherein the ballast bed comprises pieces of ballast having a maximum nominal diameter and the vehicle has a maximum nominal operating speed. A piece of ballast of the ballast bed having the maximum nominal diameter defines a nominal impact energy when hitting the shielding device at a nominal relative impact speed, the nominal relative impact speed being directed exclusively parallel to a longitudinal direction of the running gear and having an amount equal to the maximum nominal operating speed of the vehicle. In this case, to achieve proper reduction of the risk of ballast flight buildup, the impact energy absorbing device is adapted to absorb at least 5% of the nominal impact energy, in particular at least 15% of the nominal impact energy, preferably at least 25% of the nominal impact energy.

It will be appreciated that the impact element may generally be of any desired and suitable shape. In preferably simple cases, the impact element may be a plate shaped element, which is particularly easy to manufacture and handle. Furthermore, preferably, the impact element may be releasably mounted to the shielding device leading to low maintenance effort.

It will be appreciated that one single impact element may be sufficient. However, maintenance is greatly simplified and rendered more cost efficient if a plurality of impact elements is arranged at the shielding device, the plurality of impact elements, preferably, jointly forming substantially the entire impact surface for the objects hitting the shielding device.

Impact energy absorption may be achieved in any suitable way, e.g. by providing a specific structural design of the respective energy absorbing element providing energy absorption or dissipation, respectively, by friction between components or parts of the energy absorbing element. With further embodiments of the invention, the impact element comprises an impact energy absorbing material. Here, any suitable material providing a sufficient amount of impact energy absorption over sufficiently long periods or a sufficient number of individual impacts, respectively, may be chosen. Appropriate synthetic materials may be chosen as the impact energy absorbing material. In any case, it will be appreciated that arbitrary combinations of different energy absorbing materials may of course be used as well.

As mentioned initially, the energy absorption allows a more favorable arrangement (in particular, a greater inclination with respect to of the longitudinal direction of the running gear) of the impact surface of the shielding the device. It should be noted that, in the sense of the present invention, the impact surface is to be considered the part of the of the shielding device that has a likelihood of being hit by an object vertically lifted from the track (e.g. a ballast bed) of more than 10% to 20% at the nominal maximum operating speed of the vehicle (as outlined above).

Hence, with preferred embodiments of the invention, the shielding device defines an impact surface for the objects, at least 50% of the impact surface, preferably at least 80% of the impact surface, more preferably at least 90% of the impact surface, being inclined with respect to a longitudinal axis of the running gear by an inclination angle. Here, the inclination angle ranges from 35° to 70°, in particular from 40° to 60°, preferably from 45° to 50°, such that a comparatively space-saving configuration is achieved that is more easily integrated in the typically strictly limited space available in the running gear.

With other preferred embodiments of the invention, at least a part of the impact energy absorption is provided via the support of the shielding device. Hence, with a certain embodiments of the running gear according to the invention, the shielding device comprises a shielding element, the shielding element being spatially associated to the shielded component and being connected to the running gear frame via a second impact energy absorbing element. This has the advantage that, on the one hand, the energy absorption does not necessarily have to occur in the region of the impact surface such that a very simple design of the impact surface may be chosen, if desired. Furthermore, on the other hand, additional energy absorption may be achieved in a region remote from the impact surface increasing the overall impact energy absorption and, eventually, alleviating and energy absorption related problems or restrictions in the region of the impact surface.

Energy absorption may be achieved at any suitable location and in any suitable way in the region of the support of the shielding device. For example, one of the components (e.g. a support element) of the support structure itself may be designed as corresponding energy absorbing element. Preferably, the shielding element is connected to a support element of the support structure, the second impact energy absorbing element being arranged between the shielding element and the support element and/or between the support element and the running gear frame.

With advantageous embodiments of the invention, one or more components of the running gear, which are provided anyway for other functional reasons, also integrate the function of the support structure and/or the function of the second impact energy absorbing element. Hence, with certain preferred embodiments of the running gear according to the invention, the support structure comprises a support arm of a drive motor driving the wheel set, the support arm forming a support element of the support structure supporting the shielding device. With such a design, a highly functionally integrated configuration may be achieved.

The connection between the shielding device and the support structure may be achieved in any suitable way. More precisely, any type of connection (positive connection, frictional connection, adhesive connection etc) or arbitrary combinations thereof may be chosen. Preferably, a configuration is chosen that provides a connection that is failsafe insofar as it secures the shielding device against displacement (up to complete loss of the shielding device) even if fixing elements (such as, typically, threaded bolts, clamps etc) fail during operation of the vehicle.

Hence, preferably, the shielding device comprises a shielding element, the shielding element being spatially associated to the shielded component and defining a first connecting section cooperating with a second connecting section defined by the support structure. The first connecting section and the second connecting section define a positive connection, the positive connection being effective in a height direction of the running gear and/or in a longitudinal direction of the running gear, thereby providing security against displacement in the respective direction.

With certain preferred embodiments of the invention, the first connecting section comprises a pair of first brackets of the shielding element and the second connecting section comprises a pair of second brackets of the support structure. Each of the first brackets defines a longitudinal first bracket axis, while each of the second brackets defines a longitudinal second bracket axis. At least one first bracket axis and/or at least one second bracket axis is inclined with respect to a longitudinal direction of the running gear such that such a securing positive connection is obtained in a very simple manner. Preferably, at least one first bracket axis and/or at least one second bracket axis is inclined with respect to a plane defined by a longitudinal direction and a transverse direction of the running gear. This leads to a very beneficial configuration with a positive connection in, both, the longitudinal direction and the height direction providing a very high degree of safety against displacement.

The present invention also relates to a rail vehicle, in particular a high speed rail vehicle, comprising a wagon body and at least one running gear according to the invention, the wagon body being supported on the running gear. With such a vehicle that the embodiments and advantages as outlined above in the context of the running gear according to the invention may be realized to the same extent. Hence, it is here merely referred to the explanations given above.

As mentioned initially, the present invention is particularly effective in the context of high-speed rail vehicles. Hence, preferably, a nominal maximum operating speed is defined for the rail vehicle, the nominal maximum operating speed being greater than 180 km/h, preferably being greater than 200 km/h, more preferably greater than 240 km/h.

Further embodiments of the invention will become apparent from the dependent claims and the following description of preferred embodiments which refers to the appended figures. All combinations of the features disclosed, whether explicitly recited in the claims or not, are within the scope of the invention.

DETAILED DESCRIPTION OF THE INVENTION

In the following, a preferred embodiment of a high-speed rail vehicle 101 according to the invention will be described with reference to FIGS. 1 to 8. The vehicle 101 comprises a wagon body 102 supported at both of its ends (via a secondary suspension) on a preferred embodiment of a running gear according to the invention in the form of a bogie 103. The bogie 103 runs on a track T with a ballast bed comprising pieces of ballast B having a defined maximum diameter $d_{max}$.

In order to simplify the explanations given below, an x,y,z-coordinate system has been introduced into the Figures, wherein (on a straight, level track) the x-axis designates the longitudinal direction of the running gear 103 (and the vehicle 101, respectively), the y-axis designates the transverse direction of the running gear 103 (and the vehicle 101, respectively) and the z-axis designates the height direction of the running gear 103 (and the vehicle 101, respectively).

Figure 1:
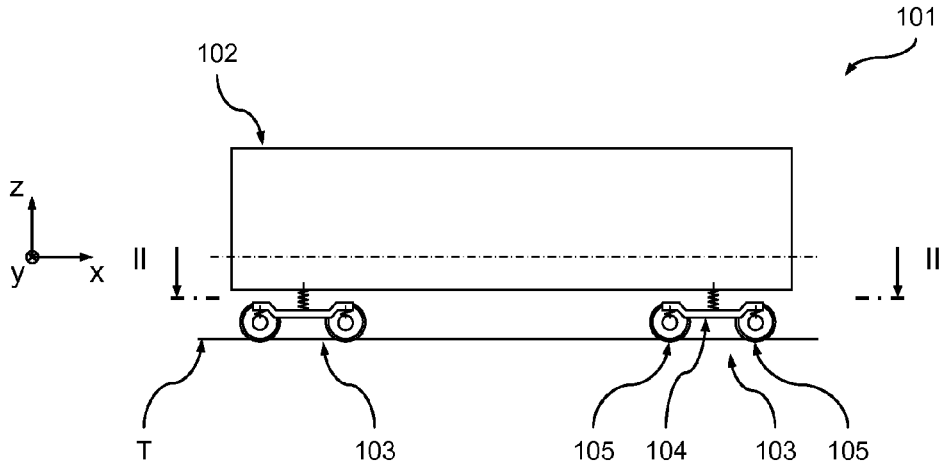
FIG. 1 is a schematic side view of a preferred embodiment of the rail vehicle according to the invention comprising a preferred embodiment of the running gear according to the invention.
Figure 2:
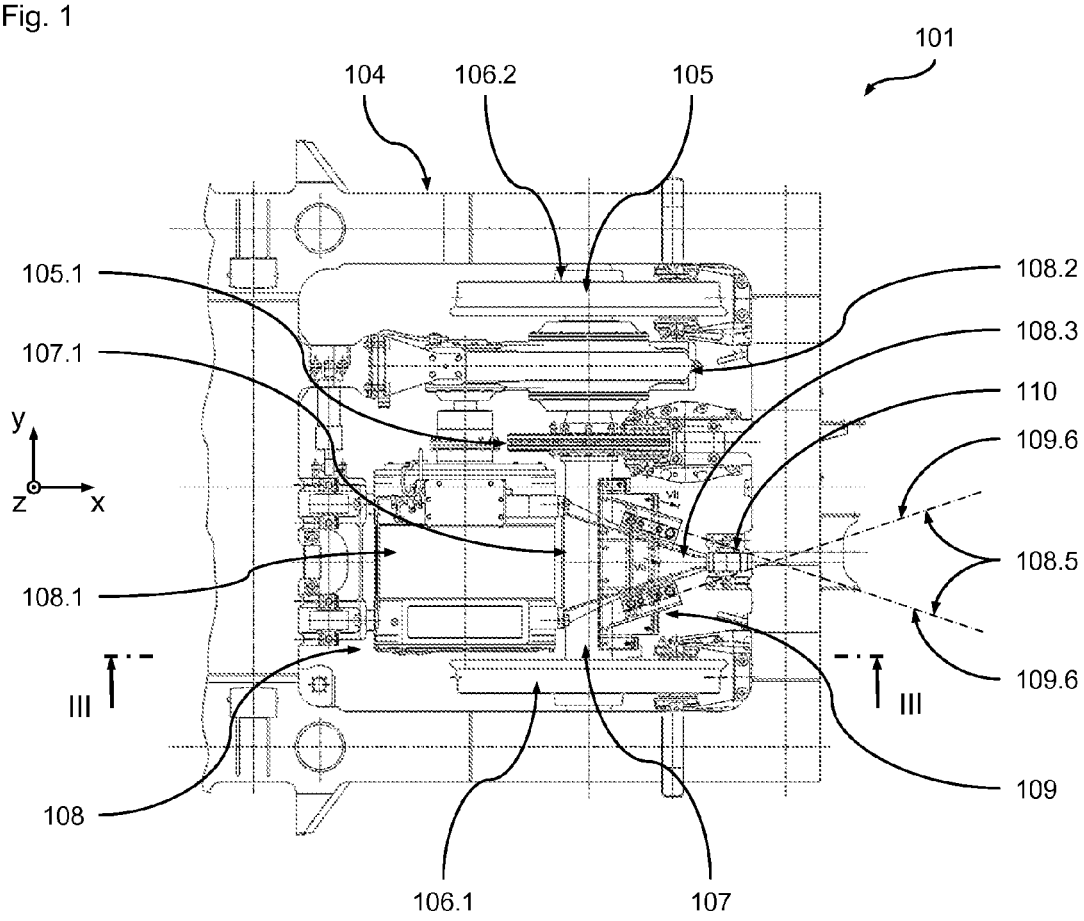
FIG. 2 is a schematic top view of a part of the running gear of FIG. 1 (seen in a section along line II-II of FIG. 1)
Figure 3:
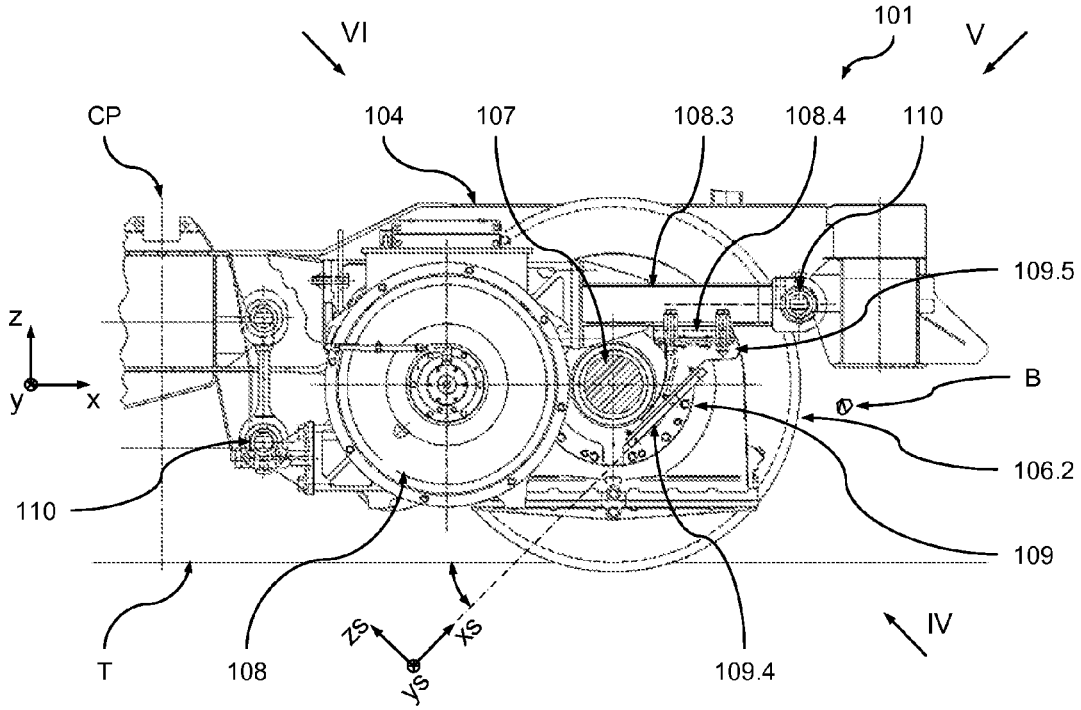
FIG. 3 is a schematic sectional representation of a part of the running gear of FIG. 2 (seen in a section along line III-III of FIG. 2)
Figure 4:
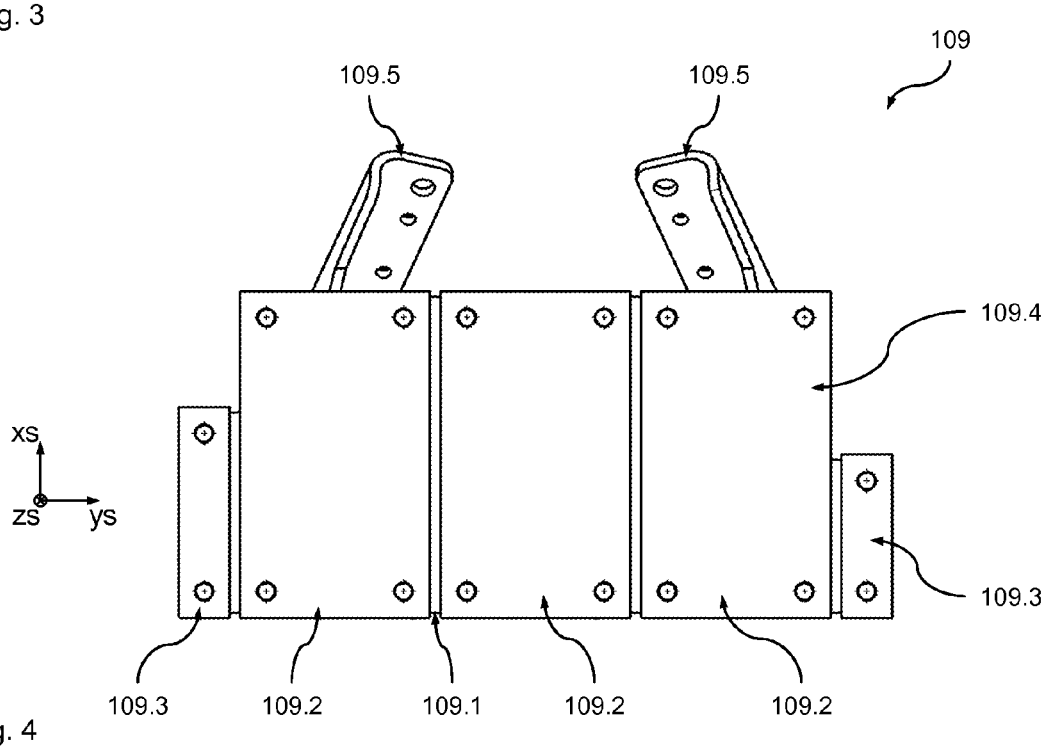
FIG. 4 is a schematic bottom view of the shielding device of the running gear of FIG. 3 (seen in the direction of arrow IV of FIG. 3)
Figure 5:
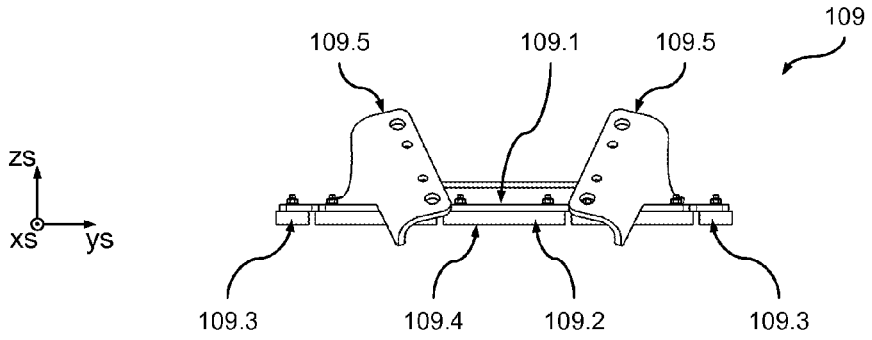
FIG. 5 is a schematic side view of the shielding device of the running gear of FIG. 3 (seen in the direction of arrow V of FIG. 3)
Figure 6:
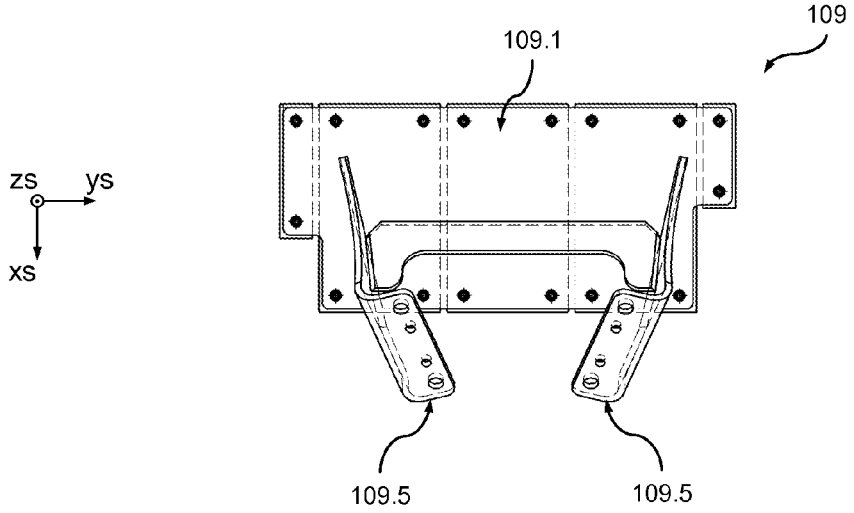
FIG. 6 is a schematic top view of the shielding device of the running gear of FIG. 3 (seen in the direction of arrow VI of FIG. 3)
Figure 7:
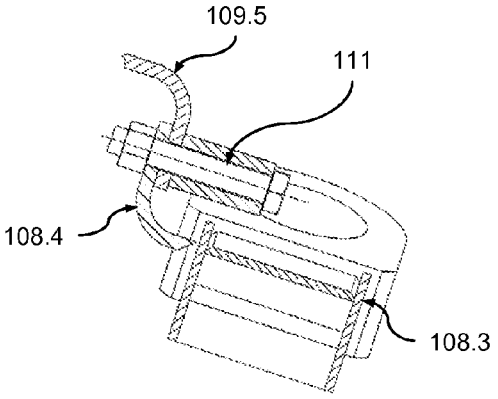
FIG. 7 is a schematic sectional representation of a detail of the running gear of FIG. 2 (seen in a section along line VII-VII of FIG. 2).

As can be seen from FIGS. 2 and 3 (both showing views of the end side half of the running gear 103 located on the right hand side of FIG. 1) media comprises a running gear frame 104 supported (in a conventional manner via a secondary suspension) on the two wheel sets 105. Each wheel set 105 comprises two wheels 106.1, 106.2 connected by a wheel set shaft 107. Each wheel set 105 is driven by an associated drive unit 108 (comprising a motor 108.1 and a gear 108.2) suspended via a drive unit suspension to the running gear frame 104.

The vehicle 101 has a nominal maximum operating speed $v_{max}$ above 240 km/h such that it faces the problem of ballast flight as it has been outlined above. Hence, it is necessary, among others, to protect safety relevant and impact sensitive components of the running gear 103 such as the (otherwise uncovered) part 107.1 of the wheel set shaft 107 against impacts of pieces of ballast B or other objects lifted in the height direction (z-direction) from the track T (comprising a ballast bed). Furthermore, there is not only the need to protect the components of the running gear 103 against impacts. It is also desirable to at least reduce the likelihood of a buildup of such ballast flight situations.

In the present example, both these needs are addressed by a shielding device 109 closely spatially associated to the wheel set shaft 107 on the end side part of the shaft facing away from the running gear center. The shielding device 109 is closely spatially associated to free part 107.1 of the wheel set shaft 107 located adjacent to the motor 108.1 between the brake disc 105.1 and the wheel 106.1. In order to simplify the explanations given below, an xs,ys,zs-coordinate system has been introduced into the Figures, the relation of which with respect to the x,y,z-coordinate system can be taken from FIG. 2.

The shielding device 109 comprises a shielding element 109.1 connected to the running gear frame 104 via a support structure in the form of a support arm 108.3. The support arm 108.3 is a part of the suspension supporting the drive device 108, and, hence, in a beneficial and space saving manner integrates the function of supporting the drive device 108 and the shielding device 109.

The generally planar and plate shaped shielding element 109.1, on its side facing away from the shaft 107 and down towards the track T, carries a plurality of impact elements 109.2, 109.3. The generally planar and plate shaped impact elements 109.2, 109.3 (apart from negligible small gaps formed in between them) together form substantially the entire impact surface 109.4 (defining the xs,ys-plane) of the shielding device 109, i.e. the part of the of the shielding device 109 that has a likelihood of being hit by an object B vertically lifted from the track T (e.g. a ballast bed) of more than 10% to 20% during normal operation at the nominal maximum operating speed $v_{max}$ of the vehicle (as outlined above). The shielding element 109.1 is connected to the support arm 108.3 via first brackets 109.5 as will be explained in greater detail further below.

Figure 8:
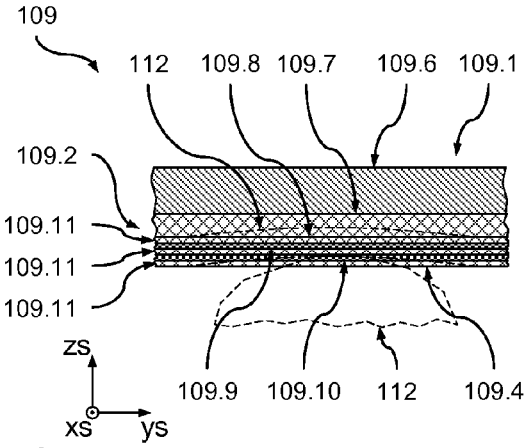
FIG. 8 is a schematic sectional representation of a detail of the shielding device of FIG. 6 (seen in a section along line VIII-VIII of FIG. 6).

As can be seen from FIG. 8, the shielding element 109.1 comprises a rear carrier element 109.6 (typically made from a metal, such as steel or the like) carrying the impact elements 109.2, 109.3. In the present example, each impact element 109.2, 109.3 comprises an impact energy absorbing element 109.7 facing the carrier element 109.6 and a load bearing structural element 109.8 forming the impact surface 109.4.

As can be further seen from FIG. 8, the structural element 109.8 is a laminate element (typically a high-pressure laminate element) made from a fiber reinforced composite material. The structural element 109.8 comprises a plurality of layers, namely a first fiber layer 109.9 and a second fiber layer 109.10 embedded within matrix layers 109.11.

The first fiber layer 109.9 is a woven fiber layer, namely a fiber texture woven from first reinforcement fibers, more precisely glass fibers. The reinforcement fibers of the first fiber layer 109.9 predominantly extend within the plane of main extension of the first fiber layer 109.9, i.e. in a plane substantially parallel to the impact surface 109.4. This first fiber layer 109.9 provides high structural stability to the structural element 109.8. The regular alignment of the fibers of the first fiber layer 109.9 is particularly beneficial under the local impact loads (when a piece of ballast B hits the impact surface 109.4, as it is indicated by the dashed contour 112 of FIG. 8) and the resulting deformation of the structural element 109.8.

As can be inferred from contour 112, the bowl-like deformation of the structural element 109.8 leads to considerable tensile loads introduced into the structural element 109.8 in the plane of main extension of the layer parts located on the side facing away from the impact surface 109.4 (i.e. the layer parts located adjacent to the impact energy absorbing element 109.7), which may be easily taken by the regularly aligned fibers of the first fiber layer 109.9 located in this area.

The second fiber layer 109.10 is a nonwoven fiber layer, namely a fiber mat, also comprising glass fibers as reinforcement fibers. The reinforcement fibers of the second fiber layer 109.10 predominantly extend within the plane of main extension of the second fiber layer 109.10, i.e. in a plane substantially parallel to the impact surface 109.4.

The reinforcement fibers of the second fiber layer 109.10 have a randomized orientation as it has been outlined above. Hence, ultimately, the second fiber layer 109.10 has substantially isotropic properties in its plane of main extension, which is highly beneficial for the area located close to the impact surface 109.4 as it has been outlined above. Hence, as can be further seen from FIG. 8, the second fiber layer 109.10 is the fiber layer located closest to the impact surface 109.4, such that a particularly long-term enduring configuration with long term overall structural integrity of the respective impact element 109.2, 109.3 is achieved in the present example using such a nonwoven fiber layer 109.10 located close to the impact surface 109.4.

While, in the present example, only two fiber layers are provided, it will be appreciated that arbitrary numbers and/or combinations and/or sequences of such woven and/or nonwoven fiber layers may be implemented with other embodiments of the invention. Hence, in particular, more than two such fiber layers may be used. For example, at least two adjacent nonwoven fiber layers 109.10 may be located close to the impact surface yielding a configuration where, at a certain point in time after local destruction of the outermost nonwoven fiber layer 109.10, the more inward located second nonwoven fiber layer 109.10 takes over the function of the destroyed part of the outermost nonwoven fiber layer 109.10.

In the present example, the fiber layers 109.9 and 109.10 are bonded together by the matrix layers 109.11 made from a matrix material embedding the fibers. Basically, any desired and suitable matrix material may be used. In the present example, the matrix material is an epoxy resin. Furthermore, the matrix material contains a mineral filler material in order to achieve a very robust and light configuration. It will be appreciated, however, that such filler material may also be omitted with other embodiments of the invention.

In the present example, particularly good and long-term stable impact protection behavior is achieved since the structural element 109.8 has a water absorption value of about 14%. Such a low water absorption is particularly beneficial in terms of the low swelling of the structural element 109.8 and, hence, the low alteration in the shape and/or size of the structural element 109.8 which influences the effort for providing long-term stable mounting of the structural element 109.8 and, hence, the impact element 109.2. The present example, a simple screw connection is sufficient which, thanks to the low alteration in shape and size of the structural element 109.8 during operation, doesn't loosen over time.

Furthermore, in the example, the structural element 109.8 has an impact strength of 25 kJ/m$^2$. By this means, a long-term enduring, highly stable configuration is achieved despite the impact loads to be typically expected from objects B lifted from track T in such a rail vehicle environment.

Furthermore, in the present example, the structural element 109.8 has a tensile strength of about 100 N/mm$^2$, a flexural strength of about 180 N/mm$^2$, a tensile elastic modulus of 25,000 N/mm$^2$, and a flexural elastic modulus of 16,000 N/mm$^2$ to 18,000 N/mm$^2$. All these parameters provide particularly beneficial properties of the structural element 109.8 and, ultimately, the impact element 109.2 since they allow realizing long-term overall structural integrity of the impact element 109.2 under the impact conditions to be expected in such a rail vehicle environment while at the same time allowing good impact energy absorption.

Furthermore, in the present example, the structural element 109.8 has a density of 1.9 g/cm$^3$, which yields a comparatively lightweight impact element 109.2 while providing long-term endurance and good impact energy absorption.

Furthermore, in the present example, the structural element 109.8 has a requirement R7 and hazard level HL2 compliance according to European Norm EN 45545-2. By this means a particularly beneficial high level of fire safety of the impact element 109.2 is achieved.

Each impact element 109.2, 109.3 is releasably connected to the shielding element 109.1 via a plurality of screw connections. Hence, rapid exchange of the respective first impact energy absorbing element 109.2, 109.3 is guaranteed.

The impact energy absorbing element 109.7 is a first impact energy absorbing element made of an impact energy absorbing material, comprising e.g. a rubber material or the like, providing good energy dissipation by internal friction. Further impact energy absorption is provided by a second impact energy absorbing element in the form of rubber bearings 110 via which the support arm 108.3 and other parts of the drive unit 108, respectively, are elastically connected to the running gear frame 104.

Hence, in the embodiment shown, in total, considerable and well noticeable impact energy absorption is achieved. More precisely, a total amount of impact energy absorption is achieved, wherein at least 15% of a nominal impact energy En of a piece of ballast B is absorbed. The nominal impact energy En is defined by a piece of ballast B having a maximum nominal diameter $d_{max}$ (of the pieces of ballast in the ballast bed of the track T) and hitting the impact surface 109.4 at a nominal relative impact speed $v_i$. The nominal relative impact speed $v_i$ is directed exclusively parallel to the longitudinal direction of the running gear 103 and has an amount equal to the maximum nominal operating speed $v_{max}$.

It will be appreciated that, with other embodiments of the invention, the impact energy absorbing element 109.7 may also be omitted, such that each impact element 109.2, 109.3 exclusively comprises a structural element 109.8 as outlined above. It will be appreciated that, in such a case, energy absorption to some extent may also occur within the structural element 109.8, wherein energy absorption is a function of the inner friction within and between the components of the structural element 109.8 (i.e. the inner friction within the matrix material, the inner friction within the filler material, the friction between matrix material and the filler material, the friction between the matrix material and/or the filler material and the reinforcement fibers as well as the friction between the reinforcement fibers themselves).

As can be seen from FIG. 2, the shielding element 109.1 is arranged such that the impact surface 109.4 is inclined with respect to the longitudinal axis (x-axis) of the running gear 103 by an angle $\alpha$=45°, which has several advantages. However, with other embodiments of the invention having non-planar shielding elements and/or non-planar energy absorbing elements (i.e. an arbitrarily curved and/or polygonal impact surface) at least 50% (up to at least 90%) of the impact surface are inclined with respect to the longitudinal axis by such a rather steep inclination angle.

Furthermore, it will be appreciated that, with other embodiments of the invention, other rather steep inclination angles $\alpha$ may be chosen. Typically, the inclination angle $\alpha$ ranges from 35° to 70° and preferably is about $\alpha$=45°±5°. This rather steeply inclined arrangement of the impact surface 109.4 has several advantages.

First, depending on the impact angle (at which the object B hits the impact surface 109.4) this inclination angle $\alpha$ produces a deflection of the hitting object B in a direction roughly vertically (i.e. roughly parallel to the height direction, i.e. the z-direction), downwards onto the track T. The subsequent (roughly) vertical impact on the track T has the advantage that the likelihood of lifting further objects B from the track T is reduced compared to a track bed impact at an oblique angle.

The impact energy absorption provided by the first energy absorbing elements 109.2, 109.3 and the second impact energy absorbing element 110 is also effectively reducing the likelihood of lifting further objects B from the track T since it reduces the kinetic energy of the object B, such that an overall reduction of the risk of ballast flight buildup is achieved, Furthermore, the (rather steep) inclination angle $\alpha$ leads to a comparatively space-saving configuration of the shielding device 109 with a comparatively small dimension of the shielding device 109 in the xs-direction such that the shielding device 109 may be easily integrated into the typically strictly limited space available in the running gear 103.

As indicated above, the connection between the shielding device 109 and the support arm 108.3 is achieved via a pair of first brackets 109.5 of the shielding element 109.1 forming a first connecting section and a pair of second brackets 108.4 of the support arm 108.3 forming a second connecting section. As can be seen, among others, from FIG. 7 the first brackets 109.5 and the second brackets 108.4 pair-wise cooperate such that a positive connection is formed, which is effective in the height direction (z-direction) of the running gear 103. Further connecting elements, such as threaded bolts 111 (reaching through bores in the first brackets 109.5 and second brackets 108.4) are used to secure the shielding element 109.1 to the support arm 108.3.

Each of the first brackets 109.5 defines a longitudinal first bracket axis 109.6, while each of the second brackets 108.4 defines a longitudinal second bracket axis 108.5 (see FIG. 2). The bracket axes 109.6, 108.5 are inclined with respect to the longitudinal direction (x-direction) of the running gear 103 such that such substantially V-shaped arrangement of the first and second connecting section is achieved.

This V-shaped configuration, on the one hand, has the advantage that the pair of first brackets 109.5 of the shielding element 109.1 may be simply hooked into the pair of second brackets 108.4 (from the side facing away from the shaft 107).

On the other hand, the V-shaped configuration may also provide security against displacement of the shielding element 109.1 in the longitudinal direction (x-direction) in case of a failure of the connecting elements 111. To this end, a slight inclination (by a few degrees, e.g. 5° to 10°) of the plane defined by the bracket axes 109.6, 108.5 with respect to the xy-plane may be chosen such that, in case of failure of the connecting elements 111, the shielding element 109.1 (e.g. under the influence of the vibrations present under normal operation) may slide towards the shaft 107 until a positive connection is formed between the first brackets 109.5 and the second brackets 108.4 in the longitudinal direction (x-direction).

However, it will be appreciated that this inclination, on the one hand, does not necessarily have to be present since the longitudinal forces generated by impacts may lead to the same result. Furthermore, with other embodiments of the invention, a stronger inclination may be chosen (for example 30° to 45°), e.g. together with a positive connection between the first and second brackets in the longitudinal direction (x-direction) formed already under normal operating conditions.

Hence, in any case, a failsafe connection is achieved insofar as it secures the shielding device 109 against displacement (up to complete loss of the shielding device 109) even if the connecting elements 111 fail during operation of the vehicle.

It will be appreciated that, in the present embodiment, a corresponding shielding device 109 is associated to the other wheel set 105 of the running gear 103 in a manner (point or mirror) symmetric with respect to the longitudinal center plane CP of the running gear 103, such that the vehicle 101 is suitable for bi-directional operation with same protection to its components.

In the foregoing, the invention has been described in the context of protecting the wheel set shaft 107. However, it will be appreciated that the shielding device may be used to shield any other desired component of the running gear 103 from such impacts. For example other security relevant and/or impact sensitive components, such as e.g. an antenna or other components of a train control system may be the shielded component.

The invention claimed is:

1. A running gear for a rail vehicle comprising:
a wheel set,
a running gear frame, and
a shielding device;
said running gear frame being supported on said wheel set;
said shielding device being connected to said running gear frame via a support structure and being spatially associated to at least a shielded component of said running gear;
said shielding device shielding a shielded part of said shielded component against impacts of objects lifted from a track during operation of said vehicle;
said shielding device comprising a rigid carrier element and at least one impact element removably mounted to said carrier element,
said at least one impact element being mounted to said carrier element for covering said carrier element and forming an impact surface for said objects;
wherein
said impact element comprises at least one load bearing structural element made from a fiber reinforced composite laminate material comprising a plurality of layers.

2. The running gear according to claim 1, wherein
said structural element comprises at least one woven fiber layer or wherein
said structural element comprises at least one nonwoven fiber layer said nonwoven fiber layer forming one of a plurality of fiber layers located closest to said impact surface.

3. The running gear according to claim 1, wherein
said structural element comprises at least one fiber layer comprising fibers, said fibers being, glass fibers, carbon fibers, or aramid fibers;
or wherein
said structural element comprises a matrix material, said matrix material being a resin;
or wherein
said structural element comprises a filler material.

4. The running gear according to claim 1, wherein
said structural element has a water absorption of less than 25%;
or wherein
said structural element has an impact strength above 15 $kJ/m^2$;
or wherein
said structural element has a tensile strength above 80 $N/mm^2$;
or wherein
said structural element has a flexural strength above 150 $N/mm^2$;
or wherein
said structural element has a tensile elastic modulus of 20,000 $N/mm^2$ to 35,000 $N/mm^2$;
or wherein
said structural element has a flexural elastic modulus of 10,000 $N/mm^2$ to 22,000 $N/mm^2$;
or wherein
said structural element has a density of 1.5 $g/cm^3$ to 2.5 $g/cm^3$
or wherein
said structural element has at least a requirement R7 and hazard level HL2 compliance according to EN 45545-2.

5. The running gear according to claim 1, wherein
said shielding device or said support structure comprises at least one impact energy absorbing device;
said impact energy absorbing device is adapted to absorb a fraction of an impact energy of one of said objects hitting said shielding device;
said impact element forms said at least one impact energy absorbing device; and
said impact element comprises an impact energy absorbing material with at least one impact energy absorbing layer.

6. The running gear according to claim 1, wherein said shielded component is a part of said wheel set.

7. The running gear according to claim 1, wherein
said shielding device shields said shielded part against impacts of pieces of ballast lifted from a ballast bed of a track used during operation of said vehicle;
said ballast bed comprising pieces of ballast having a maximum nominal diameter;
said vehicle having a maximum nominal operating speed;
a piece of ballast of said ballast bed having said maximum nominal diameter defining a nominal impact energy when hitting said shielding device at a nominal relative impact speed, said nominal relative impact speed being directed exclusively parallel to a longitudinal direction of said running gear and having an amount equal to said maximum nominal operating speed of said vehicle; and
said impact energy absorbing device being adapted to absorb at least 5% of said nominal impact energy.

8. The running gear according to claim 1, wherein
said impact element is a plate shaped element;
or wherein
said impact element is releasably mounted to said shielding device;
or wherein
a plurality of said impact elements are arranged at said shielding device, said plurality of impact elements, jointly form substantially the entire impact surface for said objects of said shielding device.

9. The running gear according to claim 1, wherein
said shielding device defines an impact surface for said objects;
at least 50% of said impact surface being inclined with respect to a longitudinal axis of said running gear by an inclination angle; and
said inclination angle ranges from 35° to 70°.

10. The running gear according to claim 1, wherein
said shielding device comprises a shielding element;
said shielding element is spatially associated to said shielded component; and
said shielding element being connected to said running gear frame via a second impact energy absorbing element.

11. The running gear according to claim 10, wherein
said shielding element is connected to a support element of said support structure; and wherein
said second impact energy absorbing element is arranged between said shielding element and said support element, or between said support element and said running gear frame.

12. A rail vehicle comprising
a wagon body and
at least one running gear according to claim 1, wherein
said wagon body is supported on said running gear.

13. The rail vehicle according to claim 12, wherein
a nominal maximum operating speed is defined for said rail vehicle; and wherein
said nominal maximum operating speed being greater than 180 km/h.

14. The running gear according to claim 1, wherein said structural element comprises at least a first fiber layer and at least a second fiber layer embedded within at least one matrix layer.

15. The running gear according to claim 14, wherein said at least one first fiber layer is a woven fiber layer woven from a plurality of reinforcement fibers arranged in a plane substantially parallel to said impact surface.

16. The running gear according to claim 14, wherein said at least one second fiber layer is a nonwoven fiber layer comprising a plurality of reinforcement fibers having isotropic properties in a plane substantially parallel to said impact surface.

17. The running gear according to claim 14, wherein said at least one matrix layer is an epoxy resin.

* * * * *